US006448937B1

(12) United States Patent
Aiken et al.

(10) Patent No.: US 6,448,937 B1
(45) Date of Patent: Sep. 10, 2002

(54) PHASED ARRAY ANTENNA WITH ACTIVE PARASITIC ELEMENTS

(75) Inventors: Richard Thomas Aiken, Convent Station; Ming-Ju Tsai, Livingston, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/557,556

(22) Filed: Apr. 25, 2000

(51) Int. Cl.[7] ..... H01Q 21/00
(52) U.S. Cl. ..... 343/817; 343/844
(58) Field of Search ..... 343/833, 834, 343/727, 797, 767, 844; H01Q 21/24, 21/26, 21/00, 21/12

(56) References Cited

U.S. PATENT DOCUMENTS 4,710,775 A * 12/1987 Coe ..... 343/727
4,922,263 A * 5/1990 Dubost et al. ..... 343/833
5,400,042 A 3/1995 Tulinseff ..... 343/727
5,940,044 A 8/1999 Smith ..... 343/810

FOREIGN PATENT DOCUMENTS

| | | | |
|---|---|---|---|
| EP | 0045254 | 7/1980 | ..... H01Q/25/00 |
| EP | 0 521 326 A2 | 7/1993 | ..... G01B/1/00 |
| WO | WO 98/50981 | 11/1998 | ..... H01Q/3/40 |

* cited by examiner

*Primary Examiner*—Michael C. Wimer
(74) *Attorney, Agent, or Firm*—Christopher N. Malvone

(57) ABSTRACT

A phased array antenna includes an active or beam forming array portion, and active parasitic elements that transmit and/or receive signals. The parasitic elements serve the dual purpose of providing a uniform impedance for elements at the edge of the array portion of the antenna while also providing active elements that are used to transmit and/or receive signals. The active parasitic elements may transmit and/or receive at the same frequency as the array portion or at a different frequency than the array portion. It is also possible for the active parasitic elements to have a different polarization than the elements of the array portion.

21 Claims, 3 Drawing Sheets

PHASED ARRAY ANTENNA WITH ACTIVE PARASITIC ELEMENTS

BACKGROUND OF THE INVENTION

1. Field of the Invention

The present invention relates to antennas; more specifically, phased array antennas.

2. Description of the Prior Art

In the past, phased array antennas have included a beam forming portion with an array of active antenna elements that transmitted or received signals, and a portion with parasitic antenna elements. The parasitic elements were inactive antenna elements that did not transmit or receive signals. The parasitic elements were adjacent to the array of active elements to provide a uniform impedance to the active elements that were on the edges of the array of active antenna elements. This resulted in the elements at the edge of the array being surrounded by approximately the same impedances as elements in the center of the array. This enabled the far-field patterns associated with the edge elements to be approximately the same as the far-field patterns associated with elements in the center of the array. Using these parasitic elements wastes antenna real estate.

SUMMARY OF THE INVENTION

The present invention provides a phased array antenna with an active or beam forming array portion, and active parasitic elements that transmit and/or receive signals. The parasitic elements serve the dual purpose of providing a uniform impedance for elements at the edge of the array portion of the antenna while also providing active elements that are used to transmit and/or receive signals. The active parasitic elements may transmit and/or receive at the same frequency as the array portion or at a different frequency than the array portion. It is also possible for the active parasitic elements to have a different polarization than the elements of the array portion.

DETAILED DESCRIPTION

Figure 1:
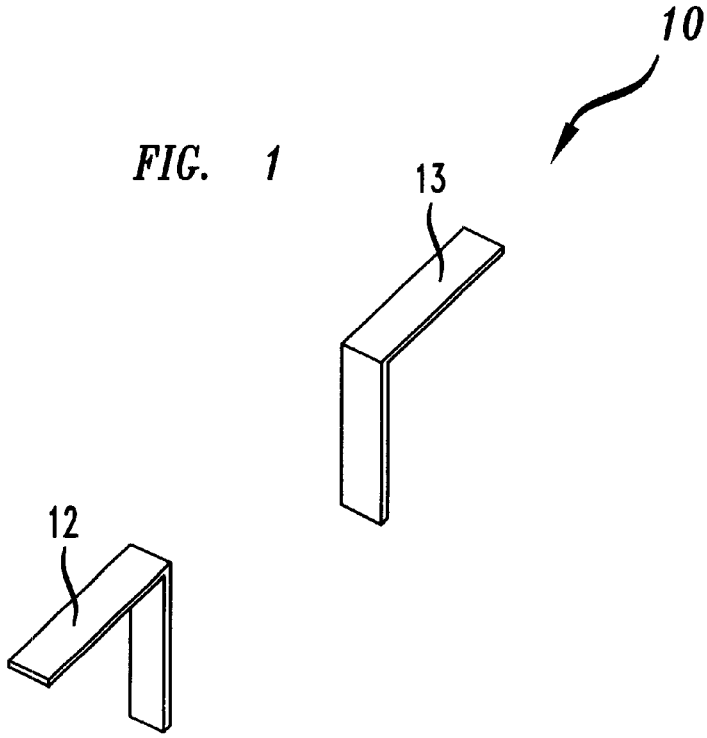
FIG. 1 illustrates a dipole antenna element.

FIG. 1 illustrates dipole element 10 where signals are fed to and received from the element at points 12 and/or 13. If an unbalanced configuration is used, signals are fed to and received from point 12, and point 13 is typically grounded. If a balanced configuration is used, signals that are 180 degrees out of phase with respect to each other are fed to and received from points 12 and 13.

Figure 2:
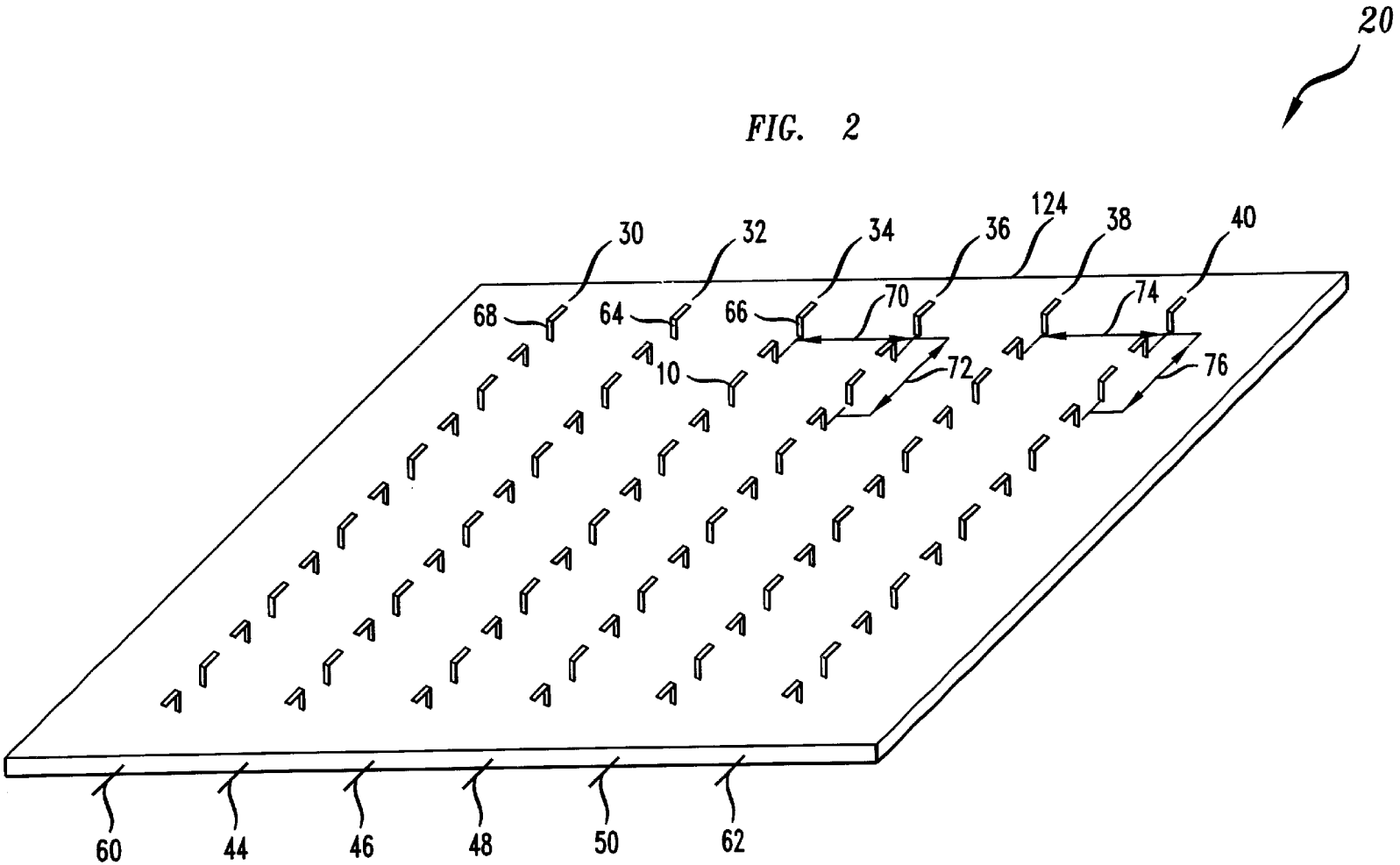
FIG. 2 illustrates a phased array antenna with active parasitic elements.

FIG. 2 illustrates antenna 20 that includes active or beam forming array antenna elements and active parasitic elements. Dipole antenna elements 10 are arranged in columns 30, 32, 34, 36, 38 and 40, and have similar polarizations. The elements of columns 32, 34, 36 and 38 compose the active or beam forming array portion of antenna 20. It should be noted that a four column by six row array is being shown for illustrative purposes and that other size arrays may be used.

Signals to and from the elements of columns 32, 34, 36 and 38 may be conducted via corporate feed patterns or networks connected to leads 44, 46, 48 and 50, respectively. The relative phases and amplitude of the signals on leads 44, 46, 48 and 50 may be used to control the shape and direction of the beam produced by the array antenna elements. The circuit conductors composing the corporate feed patterns or networks may be placed on a front or back surface of antenna 20 or on an internal layer of antenna 20, if the antenna is constructed using a multilayer design. It it also possible to conduct signals to and from the elements of columns 32, 34, 36 and 38 using other feed patterns such as individual feed patterns that connect to a separate lead for each element in the array.

Element columns 30 and 40 provide active parasitic elements for the antenna. The parasitic elements of columns 30 and 40 are fed using a pattern such as a corporate feed pattern or network, and thereby transmit and/or receive signals that are received from or provided to signal leads 60 and 62, respectively. The purpose of the parasitic elements in columns 30 and 40 is to provide a uniform impedance to the array elements in edge columns 32 and 38, respectively. For example, array antenna element 64 is surrounded by approximately the same impedance as array antenna element 66 because both elements 64 and 66 have antenna elements on their left and right sides. Therefore, as a result of parasitic antenna element 68, the far-field pattern created by array edge element 64 is approximately the same as the far-field pattern created by element 66.

The elements in the array portion of antenna 20 are spaced apart based on the carrier frequency of the signals that will be received and/or transmitted by the array elements. Distance 70 between the columns of the array antenna elements should be equal to approximately 0.5 wavelengths of the carrier frequency, and distance 72 between rows of the array antenna elements should be approximately 0.8 wavelengths of the carrier frequency. When the active parasitic elements in columns 30 and 40 transmit and/or receive at the same frequency that is used by the elements of the array portion of antenna 20, distance 74 between a parasitic element column and an edge column of the array elements should be within approximately 0.8 wavelengths of the carrier frequency and preferably approximately 0.5 wavelengths of the carrier frequency. Distance 76 between rows of the parasitic elements should be approximately 0.8 wavelengths of the carrier frequency. It is possible to use different carrier frequencies for the array elements and the parasitic elements. If different frequencies are used, a frequency midway between the frequency used by the array elements and the parasitic elements may be used as a reference frequency when positioning the parasitic elements on antenna 20. For example, if the array elements are to operated at a frequency $f_1$, and the parasitic elements are to operate at a higher frequency $f_2$, the reference frequency $f_r$ is defined by $$f_r = f_1 + \frac{(f_2 - f_1)}{2}$$

In this case, distance 74 between the column of parasitic elements and last column of array elements should be less than 0.8 wavelengths of the frequency $f_r$, and preferably approximately equal to 0.5 wavelengths of the frequency $f_r$. Distance 76 between the rows of the parasitic elements is approximately 0.8 wavelengths of frequency $f_r$.

Figure 3:
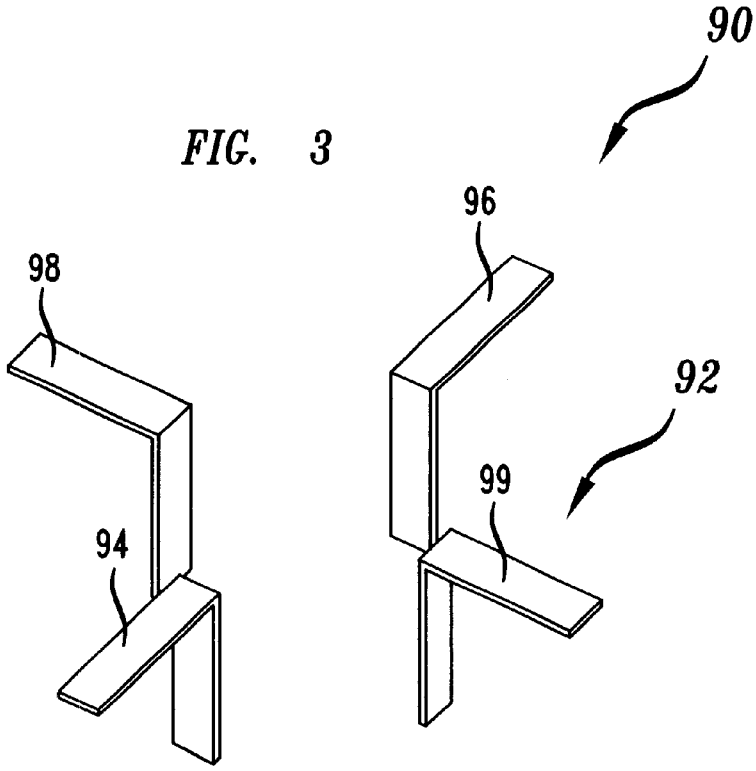
FIG. 3 illustrates two dipole antenna elements that have orthogonal polarizations.

FIG. 3 illustrates an active parasitic element comprising two subelements; however, it is possible to have more than two subelements. In this example, the subelements are dipole elements 90 and 92 that are arranged to have orthogonal polarizations. As was discussed with regard to dipole element 10, signals are fed to and received from dipole 90 at points 94 and/or 96. Likewise, signals are fed to and received from dipole 92 at points 88 and/or 89.

Figure 4:
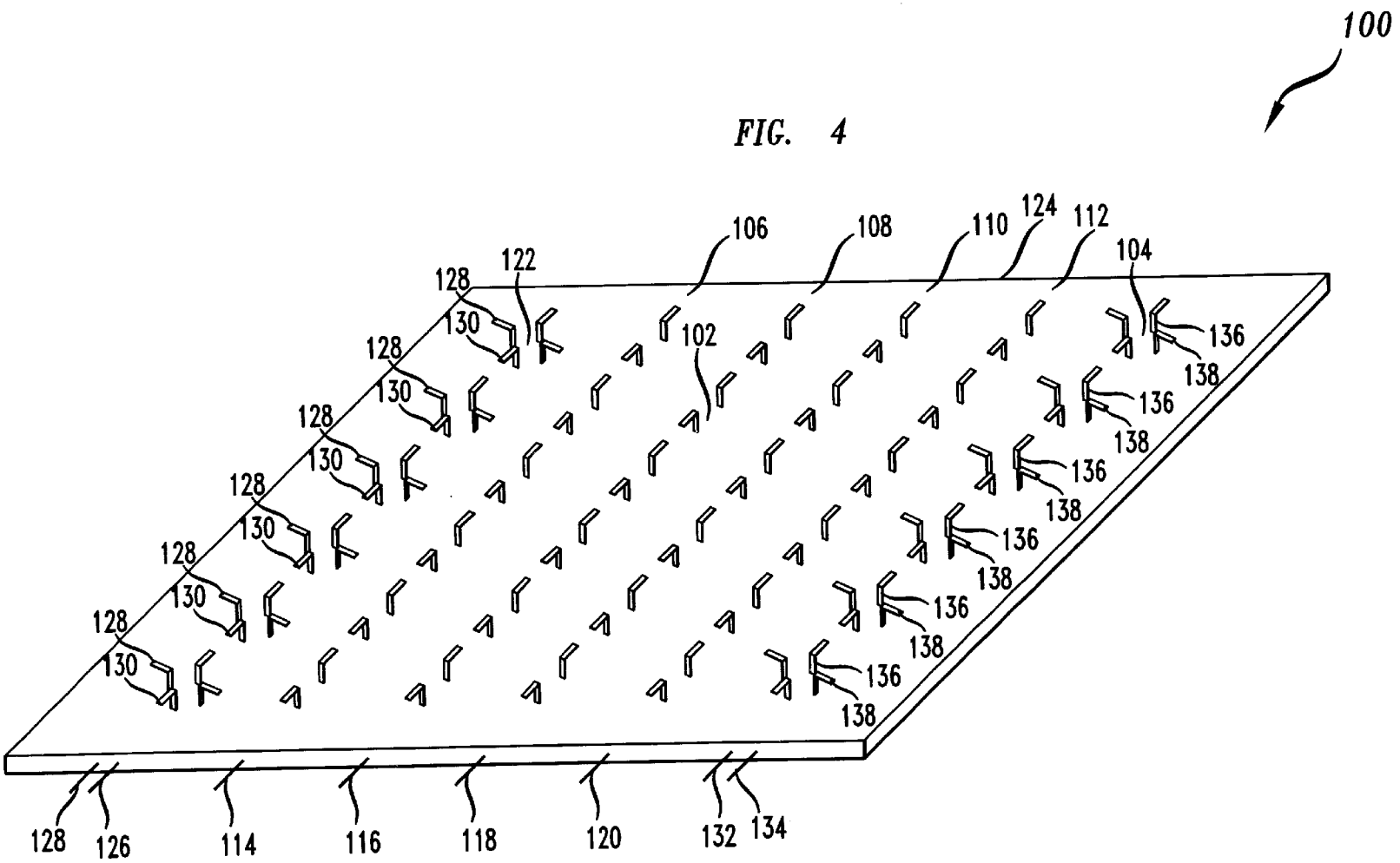
FIG. 4 illustrates a phased array antenna with active parasitic elements where the active parasitic elements have a different polarization than the array elements.

FIG. 4 illustrates antenna 100 having dipole array elements 102 and parasitic elements 104. Parasitic elements 104 are orthogonally polarized dipoles. As discussed with regard to FIG. 1, array element columns 106, 108, 110 and 112 may be corporately fed by signal leads 114, 116, 118 and 120, respectively. It should be noted that the array portion of antenna 100 may be used to transmit and/or receive signals, and that the beam shape and direction produced by the array elements is controlled by controlling the relative phases and amplitudes of the signals on lines 114, 116, 118 and 120. Signals are transmitted to and received from parasitic column 122 via a feed pattern such as a corporate feed pattern or network using leads 124 and 126, where lead 124 is connected to dipole 128 and lead 126 is connected to dipole 130. Similarly, the parasitic elements of column 124 transmit and receive signals from leads 132 and 134 via a feed pattern such as corporate feed patterns or networks where dipoles 136 are connected to lead 132, and dipoles 138 are connected to lead 134. It should be noted that it is possible to use only one of the cross polarized parasitic elements in each of the parasitic columns rather than both elements. It is also possible to use one parasitic element polarization for receiving and the other parasitic element polarization for transmitting. In the embodiment of FIG. 4, the parasitic elements do not have the same polarization as the array elements. The dipoles in parasitic columns 122 and 124 have a 45 degree difference in polarization with regard to the array elements. This configuration trades off a decrease in the uniform impedance provided to the array elements in exchange for providing diversity owing to the difference in polarization. The dipoles composing each parasitic element have a 90 degree orientation with respect to each other. This offers the advantage of providing a reasonably uniform impedance environment to the array elements while providing good polarization diversity between the dipoles composing the parasitic elements. It should be noted that parasitic elements having other polarizations such as vertical and horizontal polarizations may be used in place of the ±45 degree polarizations.

Parasitic elements 128, 130, 136 and 138 may be used to transmit and/or receive at the same carrier frequency as the array elements or at a different frequency than the array elements. If a different carrier frequency is used, and as discussed with regard to FIG. 2, the placement of the parasitic elements is based on the wavelength of a reference frequency. It is also possible for the parasitic elements to transmit and/or receive signals at the same time as the array elements or at different times than the array elements. It should also be noted that the antenna elements and subelements used in both the array portion and the parasitic element portion of the antennas of FIGS. 2 and 4 are not limited to dipole elements. Elements such as slots or patches may be used.

The invention claimed is:

1. An antenna, comprising:

a beam forming array having a plurality of array elements; and a plurality of active parasitic elements positioned adjacent to the beam forming array, where the plurality of active parasitic elements are fed separately from the plurality of array elements.

2. The antenna of claim 1, wherein the array elements and the active parasitic elements are dipole elements.

3. The antenna of claim 1, wherein the array elements and the active parasitic elements are slot elements.

4. The antenna of claim 1, wherein the array elements are a first type of element and the active parasitic elements are a second type of element, where the first type of element is different than the second type of element.

5. The antenna of claim 4, wherein the first type of element is a dipole element and the second type of element is a slot element.

6. The antenna of claim 4, wherein the first type of element is a slot element and the second type of element is a dipole element.

7. The antenna of claim 1, wherein the array elements operate at a different frequency than the active parasitic elements.

8. The antenna of claim 1, wherein the array elements operate at a different time than the active parasitic elements.

9. The antenna of claim 1, wherein the array elements have a different polarization than the active parasitic elements.

10. The antenna of claim 9, wherein the different polarization is approximately 45 degrees.

11. The antenna of claim 1, wherein an active parasitic element is positioned within approximately 0.8 array frequency wavelengths of an array element, where an array frequency is a carrier frequency used by the beam forming array.

12. The antenna of claim 1, wherein an active parasitic element is positioned within approximately 0.8 reference frequency wavelengths of an array element, where a reference frequency is between a first carrier frequency used by the beam forming array and a second carrier frequency used by the active parasitic element.

13. An antenna, comprising:

a beam forming array having a plurality of array elements; and a plurality of active parasitic elements positioned adjacent to the beam forming array, where at least one of the active parasitic elements comprises more than one subelement, and where the plurality of active parasitic elements are fed separately from the plurality of array elements.

14. The antenna of claim 13, wherein at least one of the active parasitic elements comprises two dipole elements.

15. The antenna of claim 13, wherein at least one of the active parasitic elements comprises two slot elements.

16. The antenna of claim 13, wherein the array elements have a different polarization than at least one of the subelements of an active parasitic element.

17. The antenna of claim 13, wherein the array elements have a different polarization than two of the subelements of an active parasitic element.

18. The antenna of claim 13, wherein a first subelement and second subelement have a different polarization.

19. The antenna of claim 18, wherein the different polarization is approximately 90 degrees.

20. The antenna of claim 13, wherein an active parasitic element is positioned within approximately 0.8 array frequency wavelengths of an array element, where an array frequency is a carrier frequency used by the beam forming array.

21. The antenna of claim 13, wherein an active parasitic element is positioned within approximately 0.8 reference frequency wavelengths of an array element, where a reference frequency is between a first carrier frequency used by the beam forming array and a second carrier frequency used by the active parasitic element.

* * * * *